US007386935B2

(12) United States Patent
Beaucage et al.

(10) Patent No.: US 7,386,935 B2
(45) Date of Patent: Jun. 17, 2008

(54) METHODS AND APPARATUS FOR CONTROLLING THE LAPPING OF A SLIDER BASED ON AN AMPLITUDE OF A READBACK SIGNAL PRODUCED FROM AN EXTERNALLY APPLIED MAGNETIC FIELD

(75) Inventors: Jacey Robert Beaucage, San Jose, CA (US); Linden J. Crawforth, San Jose, CA (US); Xiao Z. Wu, San Jose, CA (US)

(73) Assignee: Hitachi Global Storage Technologies Netherlands B.V., Amsterdam (NL)

( * ) Notice: Subject to any disclaimer, the term of this patent is extended or adjusted under 35 U.S.C. 154(b) by 0 days.

(21) Appl. No.: 11/881,623

(22) Filed: Jul. 27, 2007

(65) Prior Publication Data

US 2007/0270083 A1 Nov. 22, 2007

Related U.S. Application Data

(62) Division of application No. 10/789,561, filed on Feb. 27, 2004, now Pat. No. 7,260,887.

(51) Int. Cl.
*B23P 19/00* (2006.01)
*G11C 5/12* (2006.01)

(52) U.S. Cl. ..... 29/737; 29/603.09; 29/603.12; 29/603.23; 451/5; 451/10; 451/36; 451/41

(58) Field of Classification Search ..... 29/603.09–603.12, 603.15, 603.16, 603.18, 29/603.23, 737; 451/5, 8, 10, 36, 37, 41
See application file for complete search history.

(56) References Cited

U.S. PATENT DOCUMENTS 3,710,235 A 1/1973 Barraget et al.
3,821,815 A 6/1974 Abbott et al.
4,914,868 A 4/1990 Curch et al.
5,210,667 A 5/1993 Zammit (Continued)

FOREIGN PATENT DOCUMENTS

JP 7240010 9/1995

(Continued)

*Primary Examiner*—Paul D Kim
(74) *Attorney, Agent, or Firm*—John J. Oskorep, Esq.; Rambod Nader

(57) ABSTRACT

The lapping of a slider is controlled based on an amplitude of a readback signal which is produced from an externally applied magnetic field. A lapping plate is used to lap a slider which includes at least one magnetic head having a read sensor. During the lapping, a coil produces a magnetic field around the slider and processing circuitry monitors both a readback signal amplitude and a resistance of the read sensor. The lapping of the slider is terminated based on the monitoring both the readback signal amplitude and the resistance. Preferably, the lapping of the slider is terminated when the resistance is within a predetermined resistance range and the readback signal amplitude is above a predetermined minimum amplitude threshold or reaches its peak value. Asymmetry can also be measured in the described system, where the lapping process is terminated based on asymmetry as well as resistance and amplitude measurements.

15 Claims, 7 Drawing Sheets

U.S. PATENT DOCUMENTS 5,365,700 A * 11/1994 Sawada et al. ..... 451/28
5,559,429 A 9/1996 Mowry et al.
5,591,073 A * 1/1997 Turgeon ..... 451/314
5,696,445 A 12/1997 Inbar
5,721,488 A 2/1998 Sakai et al.
5,722,155 A 3/1998 Stover et al.
5,772,493 A 6/1998 Rottmayer et al.
5,885,131 A * 3/1999 Azarian et al. ..... 451/5
6,003,361 A 12/1999 Amin et al.
6,170,149 B1 1/2001 Oshiki et al.
6,515,475 B2 2/2003 Goubau et al.
7,260,887 B2 * 8/2007 Beaucage et al. ..... 29/603.12

FOREIGN PATENT DOCUMENTS

JP 07335792 A * 12/1995
JP 10269530 10/1998

* cited by examiner

METHODS AND APPARATUS FOR CONTROLLING THE LAPPING OF A SLIDER BASED ON AN AMPLITUDE OF A READBACK SIGNAL PRODUCED FROM AN EXTERNALLY APPLIED MAGNETIC FIELD

CROSS-REFERENCE TO RELATED APPLICATION

The present application is a divisional of and claims priority to a U.S. non-provisional patent application entitled "APPARATUS FOR CONTROLLING THE LAPPING OF A SLIDER BASED ON AN AMPLITUDE OF A READBACK SIGNAL PRODUCED FROM AN EXTERNALLY APPLIED MAGNETIC FIELD" having application Ser. No. 10/789,561 and filing date of 27 Feb. 2004, which is now U.S. Pat. No. 7,260,887, which is hereby incorporated by reference herein.

BACKGROUND OF THE INVENTION

1. Field of the Invention

This invention relates generally to methods and apparatus for making magnetic heads, and more particularly to methods and apparatus for controlling the lapping of a slider based on an amplitude of a readback signal produced from an externally applied magnetic field.

2. Description of the Related Art

Computers often include auxiliary memory storage devices having media on which data can be written and from which data can be read for later use. A direct access storage device (e.g. a disk drive) incorporating rotating magnetic disks are commonly used for storing data in magnetic form on the disk surfaces. Data is recorded on concentric, radially spaced tracks on the disk surfaces. Magnetic heads including read sensors are then used to read data from the tracks on the disk surfaces.

The dimensions of magnetic heads are shrinking rapidly as the recording density of magnetic disks continues to increase. To ensure optimal magnetic performance, these magnetic heads require tight dimension controls at both the wafer manufacturing and slider fabrication levels. Magnetic heads are formed during the wafer manufacturing process where widths, gaps, and other dimensions of the magnetic heads are defined. During such process, a wafer is typically cut into many individual sliders, each of which carries a magnetic head and associated read sensor. The sliders are mechanically lapped or polished with use of a lapping plate to achieve a flat and smooth surface finish for good mechanical performance. The lapping also defines the proper heights for the magnetic head, especially the read sensor's height (a.k.a. the "stripe height") for good magnetic performance.

Traditionally, slider fabrication was monitored and controlled with the use of Electrical Lapping Guides (ELGs). ELGs are typically formed at a kerf area of the wafer in between sliders for the sole purpose of lapping control. With today's magnetic heads, however, the alignment error between the ELG and the read sensor becomes significant relative to the stripe height. Therefore, the resistance of the read sensor may be utilized to directly control the lapping process to achieve a very tight read sensor resistance distribution. Achieving such tight resistance distribution, however, does not guarantee optimal magnetic performance. Most variations in read sensors (e.g. variations in the read gap thickness, mean-read-width or MRW, film quality, hard bias quality, etc.) are fixed from the wafer manufacturing prior to the lapping process. Thus, achieving tight resistance distribution only eliminates one of several variations which contribute to the degradation of magnetic performance. One of the key indicators of a read sensor's performance is its response to external magnetic fields, specifically its readback signal amplitude and asymmetry. Amplitude measures the read sensor's sensitivity to the magnetic field, and asymmetry measures the shape of the response.

Accordingly, what are needed are ways in which to control the lapping of sliders to optimize the performance of read sensors.

SUMMARY

According to the present application, the lapping of a slider is controlled based at least in part on a readback signal amplitude which is produced from an externally applied magnetic field. A lapping plate is used to lap the slider which includes at least one magnetic head having a read sensor. During the lapping, a coil produces a magnetic field around the slider and processing circuitry monitors both a readback signal amplitude and a resistance of the read sensor. The lapping of the slider is terminated based on monitoring both the readback signal amplitude and the resistance. Preferably, the lapping of the slider is terminated when the resistance is within a predetermined resistance range and the readback signal amplitude is above a predetermined minimum amplitude threshold or reaches its peak value.

BRIEF DESCRIPTION OF THE DRAWINGS

For a filler understanding of the nature and advantages of the present invention, as well as the preferred mode of use, reference should be made to the following detailed description read in conjunction with the accompanying drawings.

DETAILED DESCRIPTION OF THE PREFERRED EMBODIMENTS

Figure 1:
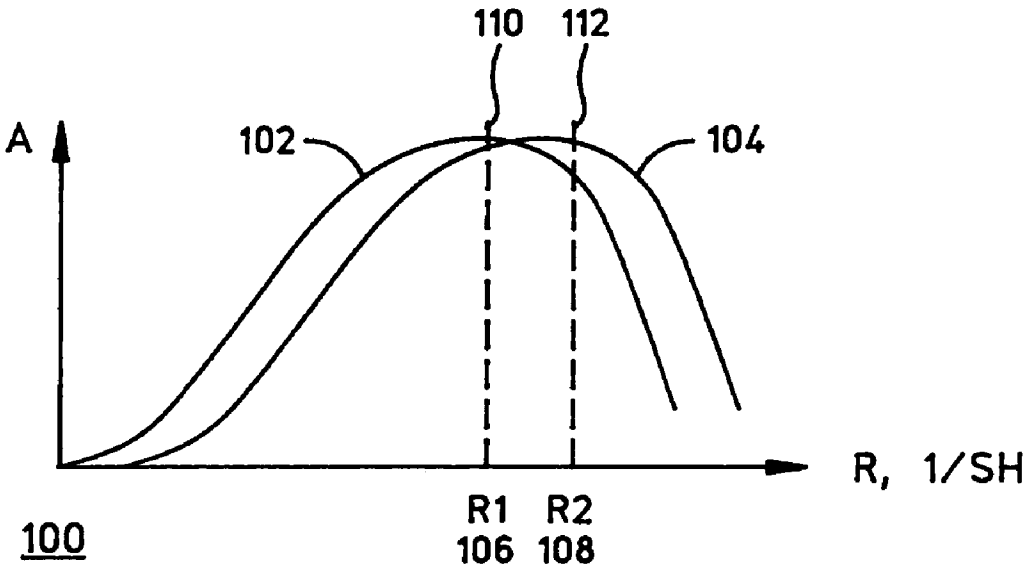
FIG. 1 is a graph which shows the readback signal amplitude versus resistance for two different read sensors.

According to the present application, the lapping of a slider is controlled based at least in part on a readback signal amplitude which is produced from an externally applied magnetic field. A lapping plate is used to lap a slider which includes at least one magnetic head having a read sensor. During the lapping, a coil produces a magnetic field around the slider and processing circuitry monitors the readback signal amplitude and a resistance of the read sensor. The lapping of the slider is terminated based on the monitoring of the readback signal amplitude and the resistance. Preferably, the lapping of the slider is terminated when the readback signal amplitude is above a predetermined minimum amplitude threshold (or that it has reached its peak value) and the resistance is within a predetermined resistance range.

As described above in the Background section, slider fabrication has been traditionally monitored and controlled with the use of Electrical Lapping Guides (ELGs). ELGs are typically formed at a kerf area of the wafer in between sliders for the sole purpose of lapping control. With today's magnetic heads, however, the alignment error between the ELG and the read sensor becomes significant relative to the stripe height. On the other hand, the resistance of the read sensor itself may be monitored and used to control the lapping process to achieve a very tight read sensor resistance distribution. Achieving such tight resistance distribution, however, does not guarantee optimal magnetic performance. Most variations in read sensors (e.g. variations in the read gap thickness, mean-read-width or MRW, film quality, hard bias quality, etc.) are fixed from the wafer manufacturing prior to the lapping process. Thus, achieving tight resistance distribution only eliminates one of several variations which contribute to the degradation of magnetic performance. Note that one of the key indicators of a read sensor's performance is its response to external magnetic fields, specifically its readback signal amplitude and asymmetry. Amplitude measures the read sensor's sensitivity to the magnetic field, and asymmetry measures the shape of the response.

During the lapping, an external magnetic field may be generated at the slider so that the readback signal from the read sensor can be used to control the lapping process. Using such a technique, it is generally desirable to lap the slider such that the readback signal amplitude is maximized or above a minimum threshold value. It has been noted, however, that the readback signal amplitude changes non-monotonically with the stripe height of the read sensor, which is inversely proportional to the resistance. As the lapping process removes materials from the slider, the read sensor's stripe height decreases while its resistance increases. When the stripe height is too long, most of the read sensor is screened from the external magnetic field, which results in too small of a detected readback signal amplitude. When the stripe height is too short, an opposing demagnetic field dominates which again results in too small of a readback signal amplitude. Thus, it has been observed that the maximum amplitude may only be achieved at an optimal stripe height or resistance value.

Due to the variations in read sensors, the readback signal amplitude may peak at different stripe height or resistance values from sensor to sensor. To illustrate such variations, a graph 100 in FIG. 1 is provided to show the readback signal amplitude versus resistance for two different read sensors. A curve 102 is representative of a first read sensor and a curve 104 is representative of a second read sensor. In graph 100, a maximum readback signal amplitude 110 of curve 102 corresponds to a resistance 106 ("R1") whereas a maximum readback signal amplitude 112 of curve 104 corresponds to a resistance 108 ("R2"). As apparent, if only resistance were used to control the lapping process, the maximum readback signal amplitude or dR/R may not be appropriately achieved for both read sensors.

Figure 2:
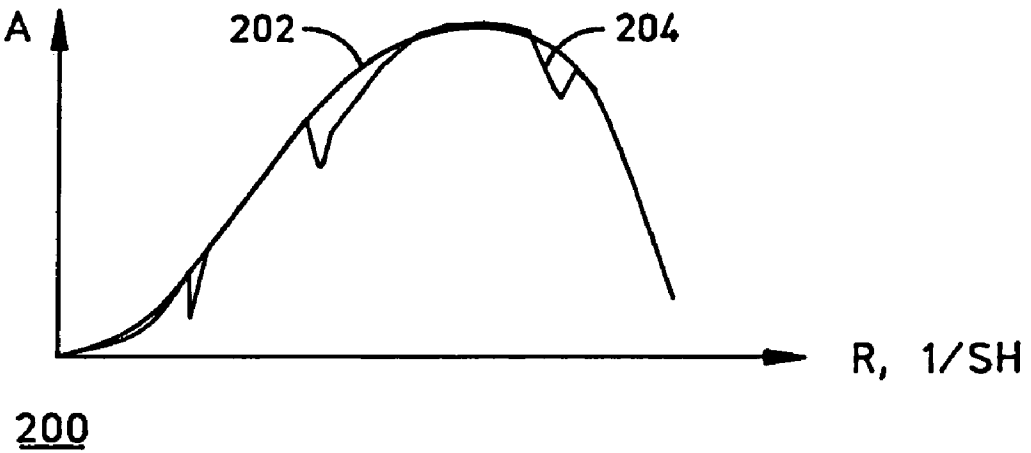
FIG. 2 is a graph which shows the readback signal amplitude versus resistance for a read sensor in both ideal form and in practice.

Note also that the readback signal amplitude may not change smoothly with the stripe height during the lapping process. To illustrate, a graph 200 in FIG. 2 is provided to show the readback signal amplitude versus resistance for a read sensor in both ideal form and in actual practice. A curve 202 illustrates the ideal form of readback signal amplitude versus resistance for the read sensor. On the other hand, a curve 204 illustrates an actual form of readback signal amplitude versus resistance for the read sensor. As apparent, the variations of readback signal amplitude during the lapping process may adversely affect the final amplitude when the slider lapping is stopped based on the final resistance only.

Figure 3:
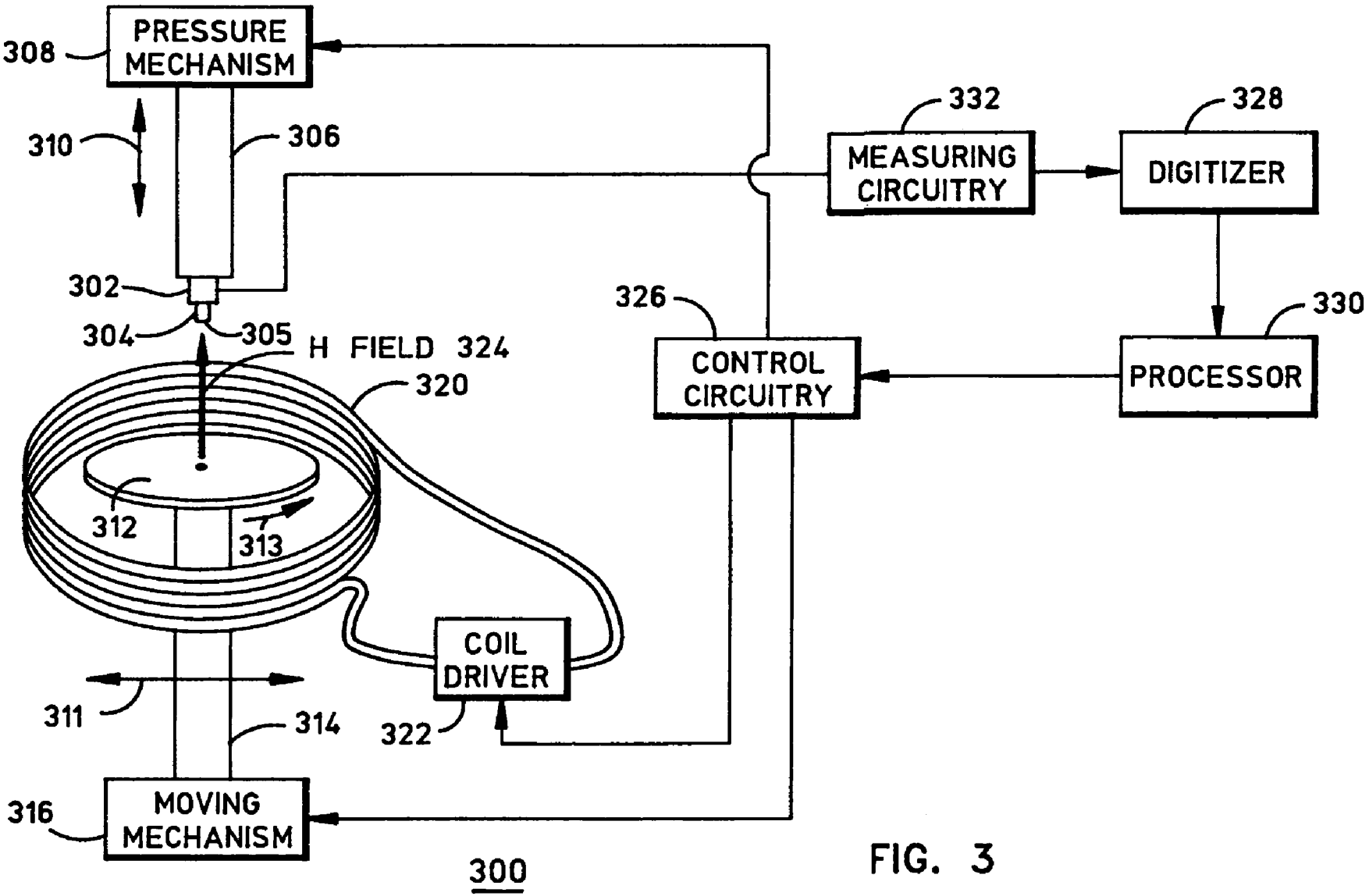
FIG. 3 is an illustration of a slider lapping system of the present application.

FIG. 3 is an illustration of a slider lapping system 300 of the present application. In general, system 300 is utilized to lap a slider 302 which includes a magnetic head 304 having a read sensor 305. Although for illustrative purposes magnetic head 304 and read sensor 305 are shown as relatively large visible components in FIG. 3, they are actually very small relative to other surrounding components and embedded within slider 302, and would not ordinarily be visible at the system level. Slider 302 is fixedly mounted to a positioning arm 306 of a pressure mechanism 308 which can apply vertical pressure for lapping purposes. Slider 302 may be mounted with use of a mechanical fixture or an adhesive gel pad, for example. A lapping plate 312 is also fixedly mounted to a positioning arm 314 of a moving mechanism 316. The top surface of lapping plate 312 has a rough texture (e.g. like "sandpaper") and, for example, may be a tin plate having diamond particles embedded on its top surface. Lapping plate 312 is typically much larger than slider 302, having a diameter of between about 10-40 cm whereas slider has dimensions of 1.2 mm (L)×1.0 mm (W)×0.3 mm (H), for example. During the lapping process, lapping plate 312 is controlled to rotate as indicated by an arrow 313. Conventionally, mechanisms 308 and 316 are controlled to move positioning arms 306 and 314 laterally (see arrow 311). Mechanical contact is made between slider 302 and lapping plate 312 (see arrow 310), such that slider 302 may be lapped or polished. The lapping of slider 302 may be terminated by either stopping all of the lateral movement (see arrow 311) or by pulling slider 302 away (see arrow 310) from lapping plate 312.

In the present embodiment, system 300 also includes an inductive coil 320 which is positioned around lapping plate 312 or slider 302. Note that the exact position of coil 320 is not important as long as the magnetic field it generates is detectable at slider 302. Coil 320 is coupled to coil driver 322, which is in turn coupled to control circuitry 326. Read sensor 305 is coupled to measuring circuitry 332, which is in turn coupled to a digitizer 328. Digitizer 328 is in turn coupled to processing circuitry 330. Digitizer 328 may include, for example, an analog-to-digital (A/D) converter for converting analog read signals from read sensor 305 into digital data. Measuring circuitry 332 provides an electrical current to read sensor 305 and preamplifies the voltage across read sensor 305. Processing circuitry 330 may utilize any suitable circuitry to process analog signals (e.g. from read sensor 305) or digital data (e.g. from digitizer 328), and preferably includes a high-speed microprocessor or digital signal processor (DSP) which operates in accordance with computer program instructions for processing digital data from digitizer 328. Processing circuitry 330 instructs control circuitry 326 in the control of mechanisms 308 and 316 and coil driver 322. Control circuitry 326 is utilized to control mechanisms 308 and 316 and coil driver 322.

Coil driver 322 is activated during the lapping process so that coil 320 produces a magnetic field 324 ("H field") at slider 320. The magnetic field 324 produced is perpendicular to lapping plate 312 and to an air bearing surface (ABS) of slider 302. Coil driver 322 may drive coil 320 using a direct current (DC) or alternating current (AC) drive signal. Magnetic field 324 may be any suitable field strength, such as between 10 and 500 Gauss. Read sensor 305 senses this magnetic field 324 and its resistance R varies in response thereto. Since the current through read sensor 305 is fixed, the resistance R is directly proportional to the voltage which is received continuously as an analog readback signal at measuring circuitry 332. Digitizer 328 converts this analog readback signal from measuring circuitry 332 into a digital signal which is received at processing circuitry 330. Processing circuitry 330 then calculates the resistance R and part of the resistance change dR responsive to the external magnetic field. The readback signal amplitude is proportional to dR/R.

With the digital read signal data, processing circuitry 330 monitors the readback signal amplitude (dR/R) from read sensor 305. In general, processing circuitry 330 instructs control circuitry 326 to terminate lapping based on the readback signal amplitude from read sensor 305. In particular, processing circuitry 330 is programmed to identify an acceptable readback signal amplitude from read sensor 305 and to terminate the lapping process when so identified. An acceptable readback signal amplitude may be identified by comparing the readback signal amplitude with a predetermined minimum amplitude threshold, or that it has reached its peak value.

Preferably, processing circuitry 330 instructs control circuitry 326 to terminate the lapping based on both the readback signal amplitude and the resistance (R) of read sensor 305. In this case, processing circuitry 330 identifies when the resistance is within a predetermined resistance range and the readback signal amplitude is above a predetermined minimum amplitude threshold or has reached its peak value. For example, the predetermined resistance range may be 20-6000 ohms and the predetermined minimum dR/R threshold (or minimum amplitude threshold) may be a value between about 0.1-10%. The resistance of the read signal may be identified by extracting and measuring the DC component from the read signal.

As stated above, coil driver 322 may drive coil 320 using a DC or AC drive signal. Preferably, the drive signal is an AC signal at a predetermined frequency $f_0$. Thus, coil driver 322 may apply a current $I=I_0 \sin(2\pi f_0 t)$ through coil 320. The predetermined frequency $f_0$ may be any suitable frequency.

If an AC drive signal is utilized, processing circuitry 330 is configured to extract the $f_0$ component to identify the readback signal amplitude (dR/R) of the read sensor. This may be done in any suitable fashion. Preferably, processing circuitry 330 includes a DSP to perform a Fast Fourier Transform (FFT) at the frequency $f_0$. Alternatively, a phase-locked-loop (PLL) process may be utilized to correlate the read signal with the frequency $f_0$. As another option, the power spectrum at the frequency $f_0$ may be assessed to identify the readback signal amplitude of the read sensor.

Figure 4:
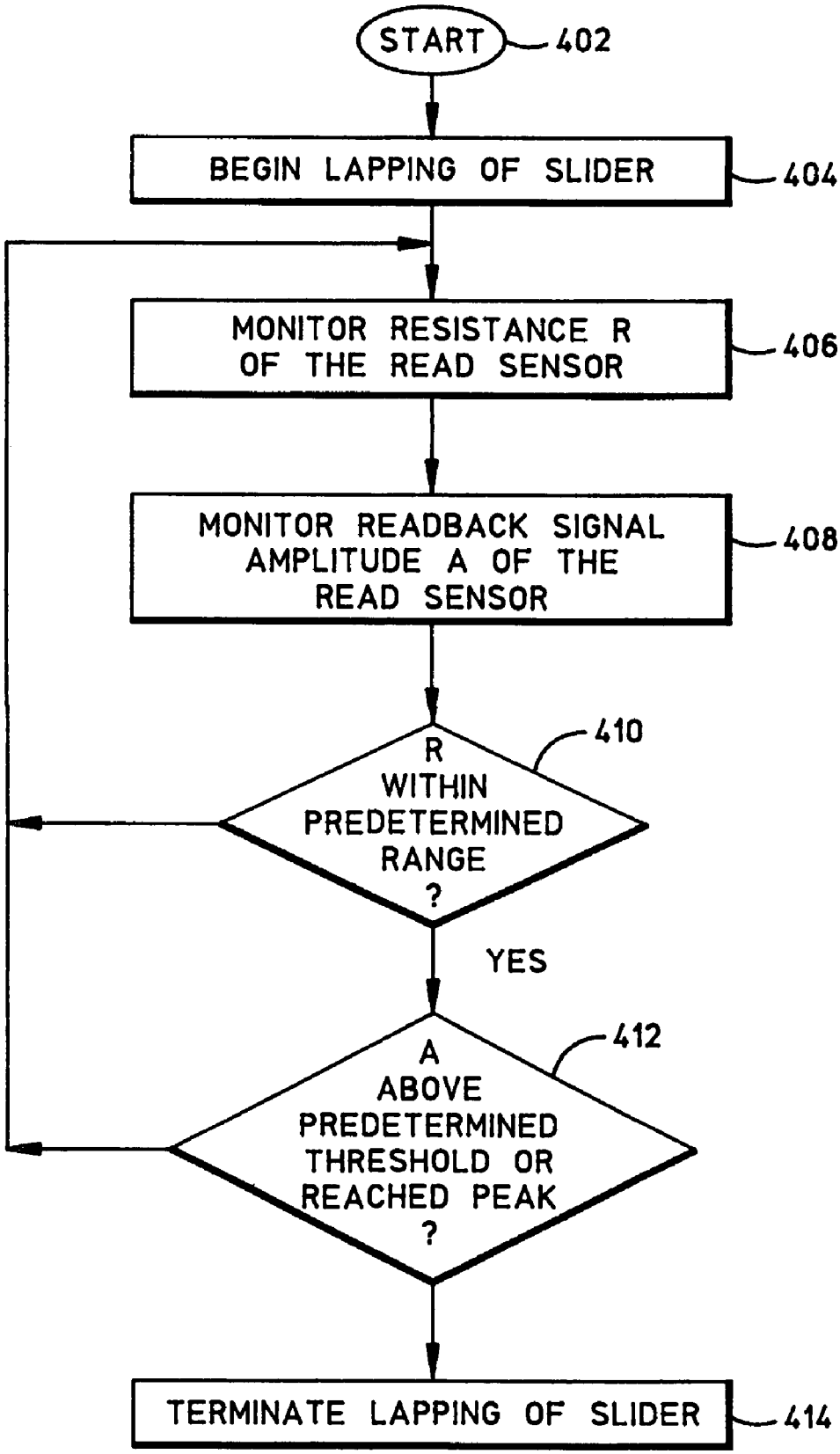
FIG. 4 is a flowchart which describes a method of controlling the lapping of a slider based at least in part on an amplitude of a detected readback signal from an externally applied magnetic field.

FIG. 4 is a flowchart which describes the method of controlling the lapping of a slider with use of the above components and techniques. The method may utilize the system described above in relation to FIG. 3. Beginning at a start block 402, a lapping process for a slider which includes a magnetic head with a read sensor is initiated (step 404). During the lapping process, a readback signal from the read sensor is continuously produced. The readback signal is produced based on a magnetic field which is generated at the slider from an inductive coil (e.g. see FIG. 3). A resistance R of the read sensor and a signal amplitude A of the readback signal are continuously monitored during the lapping (steps 406 and 408). The resistance R is tested to identify whether it is within a predetermined resistance range (step 410). The predetermined resistance range may be from 20-6000 ohms, for example. If the resistance R is not within the predetermined range, then it is tested whether the resistance R is above a maximum allowable value (step 413). If the resistance R is above the maximum allowable value at step 413, the lapping is terminated (step 414); otherwise the lapping process and monitoring continues at step 406. If the resistance is within the predetermined range at step 410, the flowchart proceeds to step 412. The readback signal amplitude A, which is proportional to the resistance change dR normalized by the resistance R (namely dR/R), is tested to identify whether it is above a predetermined minimum amplitude threshold or that it has reached its peak value (step 412). The predetermined minimum amplitude threshold may be a value between about 0.1 to 10%. If the readback signal amplitude A is not above the predetermined minimum threshold, then the lapping process and monitoring continues at step 406. If the readback signal amplitude A is greater than the predetermined minimum threshold, then the lapping of the slider is terminated (step 414).

Note that, with respect to the flowchart of FIG. 4, there may be multiple different resistance ranges utilized instead of just a single resistance range therein described. Each resistance range may be associated with a different minimum amplitude threshold. Each resistance range and associated minimum amplitude threshold is selected based on the product specification or other product information.

Figure 5:
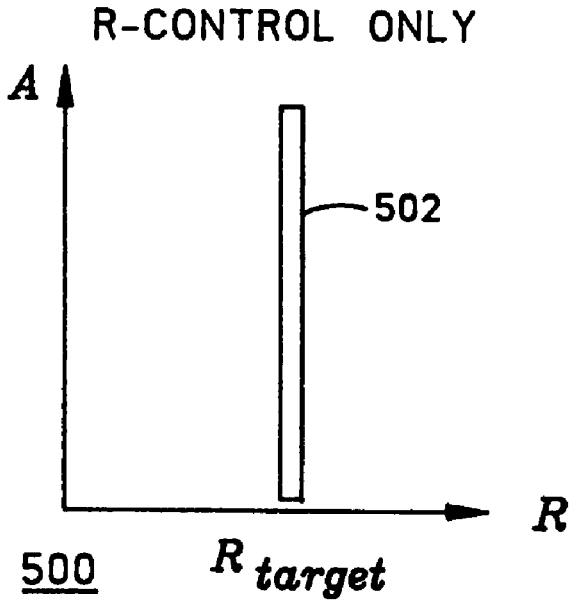
FIG. 5 is a graph of an exemplary target range for lapping which is controlled based on resistance only.
Figure 6:
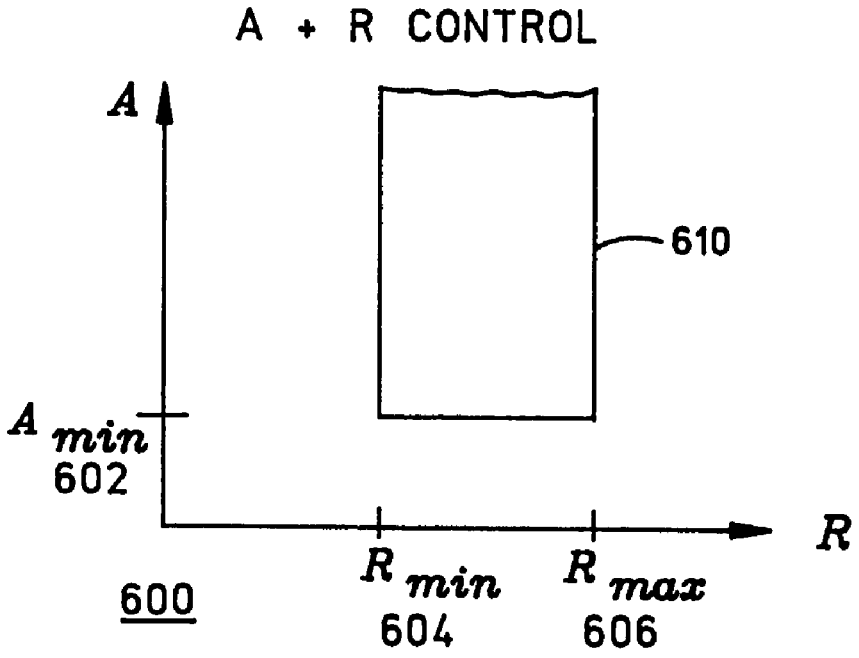
FIG. 6 is a graph which shows an exemplary target range for lapping which is controlled based on both resistance and amplitude of a readback signal.

FIG. 5 is a graph 500 of an exemplary target range for lapping which is controlled based on resistance only. On the other hand, FIG. 6 is a graph 600 which shows an exemplary target range for lapping which is controlled based on both resistance and amplitude of a readback signal. The x-axis corresponds to the resistance of the read sensor and the y-axis corresponds to the readback signal of the read sensor. Note that when the lapping is based on the resistance only (FIG. 5), the resistance range is very tight but there is no control of the amplitude range. In FIG. 6, the readback signal amplitude of the read sensor must be greater than $A_{min}$ 602 (i.e. the predetermined minimum amplitude threshold). Further, the resistance of the read sensor must be between $R_{min}$ 604 (minimum resistance value) and $R_{max}$ 606 (maximum resistance value) which defines the predetermined resistance range. Again, the predetermined minimum amplitude threshold (minimum dR/R) may be a value between about 0.1-10% and the predetermined resistance range may be from 20-6000 ohms depending on the product specification or product information.

Figure 7:
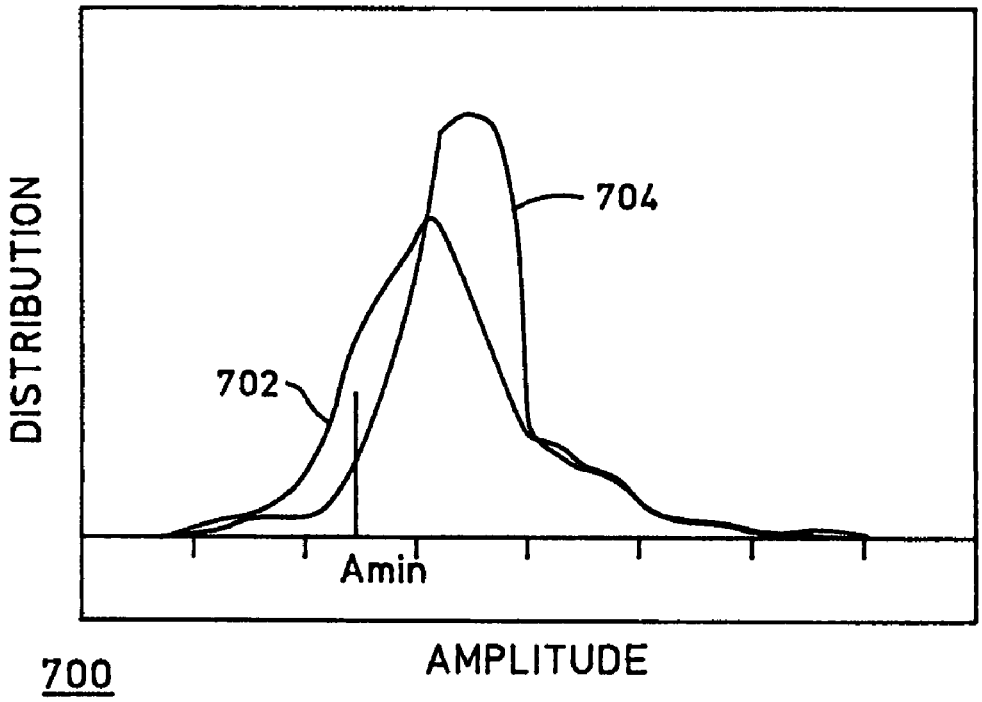
FIG. 7 is a graph which shows the distribution of readback signal amplitude for various read sensors, where one group of read sensors were lapped based on resistance only and another group of read sensors were lapped based on both readback signal amplitude and resistance.
Figure 8:
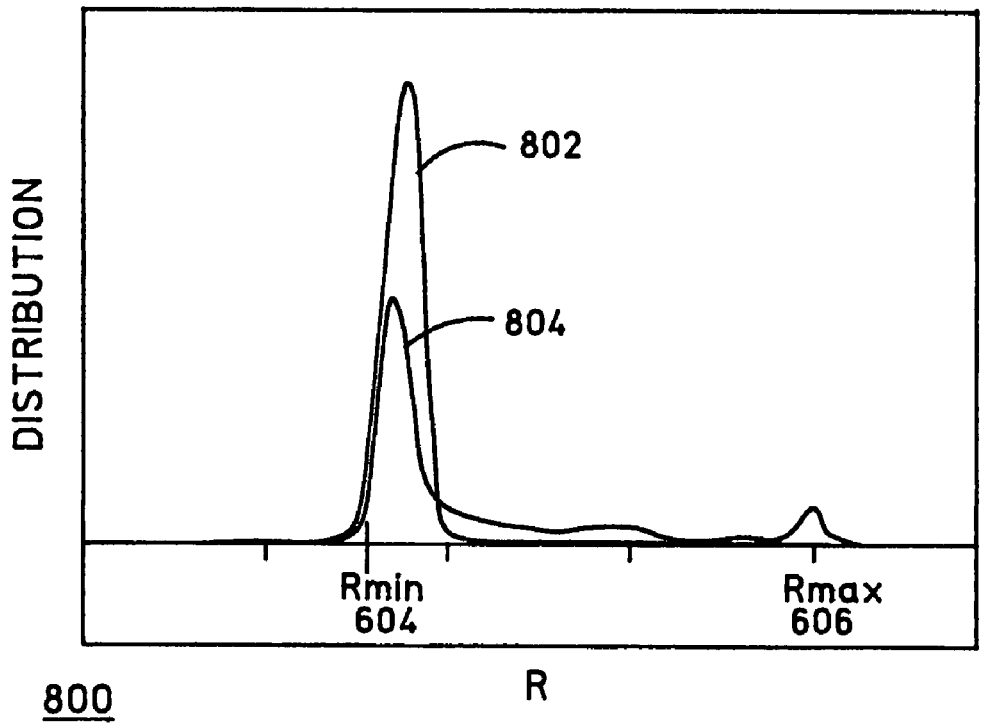
FIG. 8 is a graph which shows the distribution of resistance (R) for various read sensors, where one group of read sensors were lapped based on resistance only and another group of read sensors were lapped based on both readback signal amplitude and resistance.

FIG. 7 shows a graph 700 of the distribution of readback signal amplitude of read sensors, where one group of read sensors were lapped based on resistance only (a data curve 702) and another group of read sensors were lapped based on both readback signal amplitude and resistance (a data curve 704). As apparent, the group lapped with both amplitude and resistance control has a tighter amplitude distribution, and especially less population in the lower amplitude region. Since a read sensor with a lower amplitude will not perform satisfactorily in a disk drive and will be rejected during testing, the group with both amplitude and resistance control will have a higher yield and result in better performance than the group with resistance control only. FIG. 8 shows a graph 800 of the resistance distribution of read sensors. The group lapped with resistance control only (a data curve 802) has a very tight resistance distribution. As a consequence of tighter amplitude distribution, the group lapped with both amplitude and resistance control (a data curve 804) has a broader resistance distribution, which is bounded by Rmin 604 and Rmax 606 (see also FIG. 6). Typically there is a resistance range window within which the read sensors will perform satisfactorily. As long as Rmin and Rmax are set to be within this resistance window in the lapping method, the benefit of achieving tighter amplitude distribution (or smaller percentage of low amplitude population) will far outweigh the consequence of a slightly broader resistance distribution.

Figure 9:
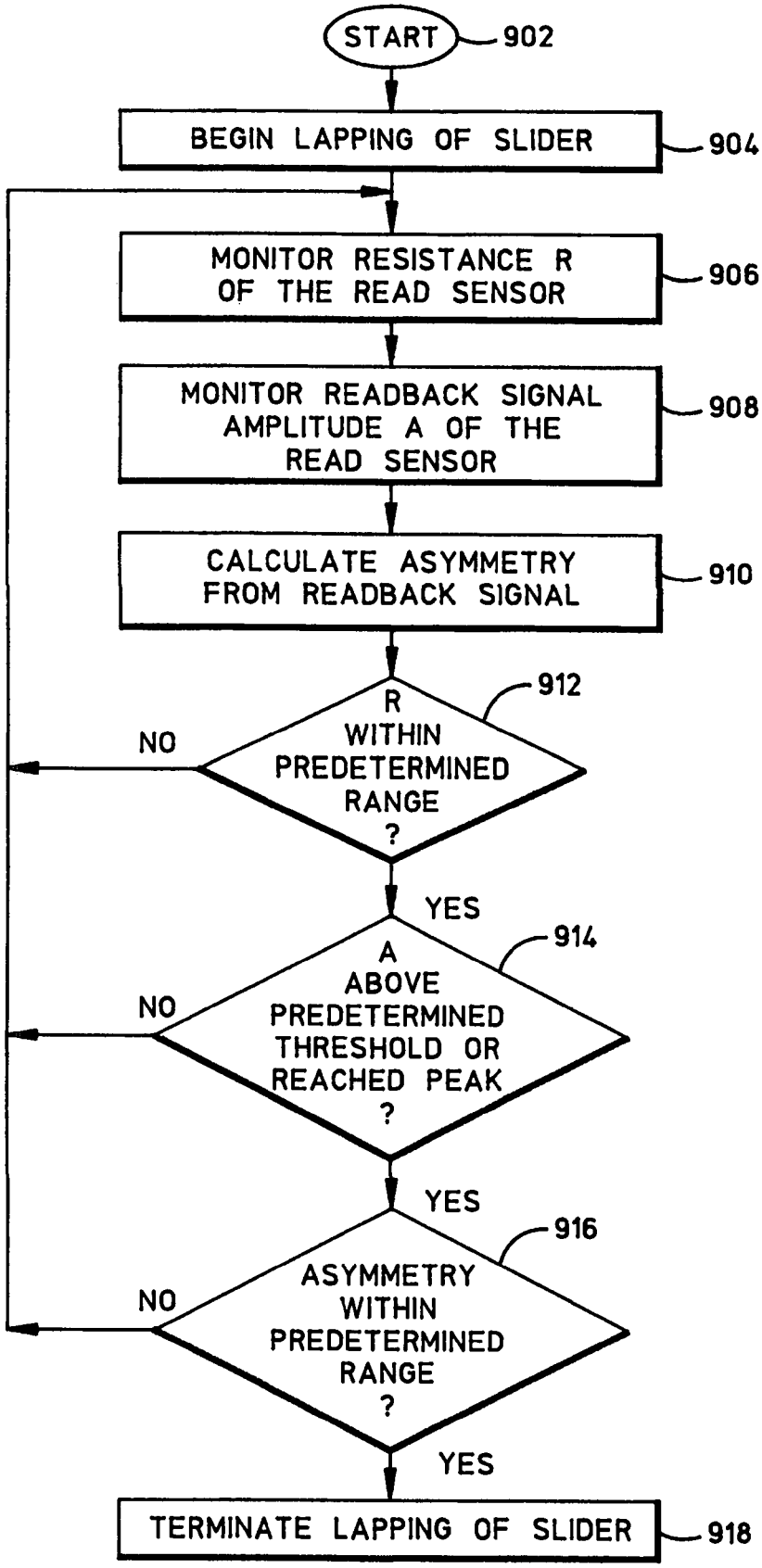
FIG. 9 is a flowchart which describes a method of controlling the lapping of a slider to reduce the asymmetry range of the read sensor.

FIG. 9 is a flowchart which describes a further method of controlling the lapping of a slider to reduce asymmetry of a read sensor. Asymmetry refers to an undesirable characteristic where a read sensor's response to external magnetic fields is not symmetric in the positive and negative directions. The method of FIG. 9 may utilize the system described above in relation to FIG. 3.

Beginning at a start block 902 of FIG. 9, a lapping process for a slider which includes a magnetic head with a read sensor is initiated (step 904). During the lapping process, a readback signal from the read sensor is continuously produced. The readback signal is produced based on a magnetic field which is generated at the slider from an inductive coil. A resistance R of the read sensor and a signal amplitude A of the readback signal are continuously monitored (steps 906 and 908). In addition, an asymmetry measurement is calculated based on the readback signal (step 910). The asymmetry measurement calculation is generally based on a ratio of the $2^{nd}$ harmonic ($2f_0$) and the "$1^{th}$" harmonic ($f_0$) of the read signal, and is described in more detail below in relation to FIG. 10.

The resistance R is then tested to identify whether it is within a predetermined resistance range (step 912). The predetermined resistance range may be from 20-6000 ohms, for example. If the resistance R is not within the predetermined range at step 912, then it is tested whether the resistance R is above a maximum allowable value (step 913). If the resistance R is above the maximum allowable value at step 913, the lapping is terminated (step 918); otherwise the lapping process and monitoring continues at step 906. If the resistance is within the predetermined range at step 912, the flowchart proceeds to step 914. The readback signal amplitude A, which is proportional to the resistance change dR normalized by the resistance R (namely dR/R), is tested to identify whether it is above a predetermined minimum amplitude threshold or that it has reached its peak value (step 914). The predetermined minimum amplitude threshold may be a value between about 0.1 to 10%. If the readback signal amplitude A is not above the predetermined minimum threshold, then the monitoring continues at step 906. If the readback signal amplitude A is greater than the predetermined minimum threshold, then the flowchart proceeds to step 916.

The asymmetry measurement is then tested to identify whether it falls within a predetermined asymmetry range (step 916). In general, asymmetry is defined to be within a range of −1 to +1. The predetermined asymmetry range for the present method may therefore be within the maximum possible range of −1 to +1 or within a tighter asymmetry range (e.g. between −0.5 to +0.5). If the asymmetry measurement is not within the predetermined range, then the lapping process and monitoring continues at step 906. If the asymmetry measurement is within the predetermined range, then the lapping of the slider is terminated (step 918).

Figure 10:
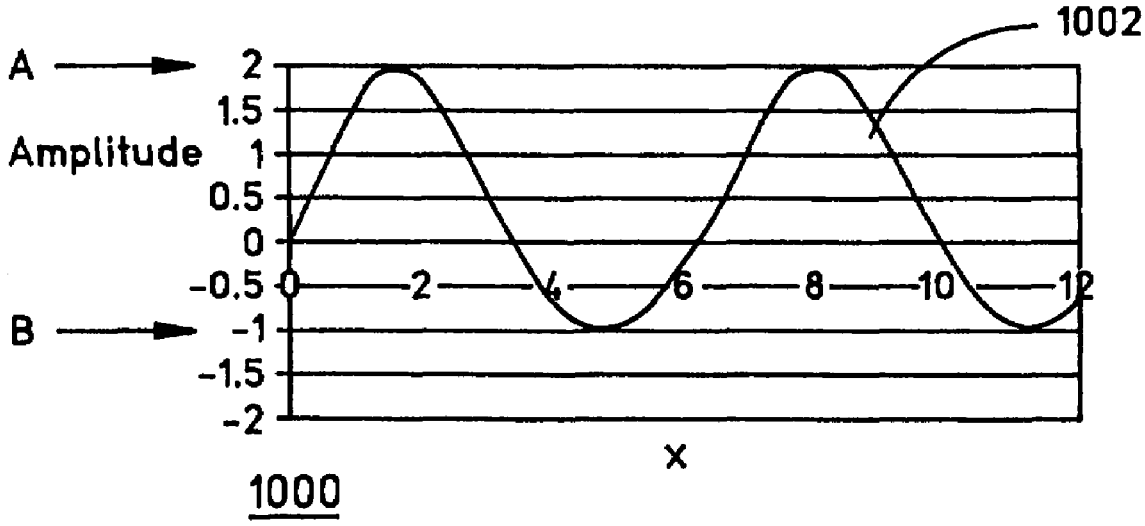
FIG. 10 is a graph which shows a signal for asymmetry measurement calculations in the method described in relation to FIG. 9.

FIG. 10 is a graph 1000 which shows a signal related to asymmetry measurement calculation for the method described in relation to FIG. 9. Graph 1000 shows a read signal 1002 having asymmetry, as the signal level is greater above the x-axis than below the x-axis in this example. If the read sensor's resistance change is characterized as $dR/R = A \sin(2\pi f_0 t)$ for the positive field and $dR/R = B \sin(2\pi f_0 t)$ for the negative field, the asymmetry=(A−B)/(A+B). A is the peak signal (positive side) and B is the peak signal (negative side). The average readback signal amplitude (A+B)/2 may be obtained based on the $1^{st}$ harmonic ($f_0$) peak of the FFT since its value is (A+B)/2. The $2^{nd}$ harmonic ($2f_0$) of the read signal may be calculated as $-2(A-B)/3\pi$. Therefore, the $\text{Peak}(2f_0)/\text{Peak}(f_0) = -(A-B)/(A+B)*4/3\pi$. That is, the asymmetry measurement $(A-B)/(A+B) = -3\pi/4\ \text{Peak}(2f_0)/\text{Peak}(f_0)$. As apparent, the asymmetry measurement calculation is therefore based on a ratio of the $2^{nd}$ harmonic ($2f_0$) and the $1^{st}$ harmonic ($f_0$) of the read signal. The lapping of the slider is terminated when the asymmetry measurement falls within the predetermined acceptable range.

Final Comments. As described herein, the lapping of a slider is controlled based at least in part on an amplitude of a readback signal which is produced from an externally applied magnetic field. A lapping plate is used to lap a slider which includes at least one magnetic head having a read sensor. During the lapping, a coil produces a magnetic field around the slider and processing circuitry monitors both a readback signal amplitude and a resistance of the read sensor. The lapping of the slider is terminated based on the monitoring of both the readback signal amplitude and the resistance. Preferably, the lapping of the slider is terminated when the resistance is within a predetermined resistance range and the readback signal amplitude is above a predetermined minimum amplitude threshold or reaches its peak value.

A slider lapping system includes a lapping plate for lapping a slider which includes at least one magnetic head with a read sensor; a moving mechanism which moves the lapping plate relative to the slider; a coil which produces a magnetic field around the slider during the lapping; processing circuitry which is operative to monitor a readback signal amplitude of the read sensor during the lapping; and control circuitry coupled to the moving mechanism and the processing circuitry, which is operative to cause the lapping to terminate based on the monitoring of the readback signal amplitude.

In a related technique, a method involves lapping a slider which includes at least one magnetic head and, during the lapping of the slider, performing the following steps: producing a magnetic field around the magnetic head; monitoring a readback signal amplitude of a read sensor of the magnetic head which varies during the lapping of the slider; generating an asymmetry measurement based on the monitored readback signal amplitude; and terminating the lapping of the slider based at least in part on the monitoring of the asymmetry measurement.

It is to be understood that the above is merely a description of preferred embodiments of the invention and that various changes, alterations, and variations may be made without departing from the true spirit and scope of the invention as set for in the appended claims. Few if any of the terms or phrases in the specification and claims have been given any special meaning different from their plain language meaning, and therefore the specification is not to be used to define terms in an unduly narrow sense.

What is claimed is:

1. A slider lapping system, comprising:

a lapping plate for lapping a slider which includes at least one magnetic head with a read sensor;

a moving mechanism which moves the lapping plate relative to the slider;

a coil which produces a magnetic field around the slider during the lapping;

processing circuitry which is operative to calculate and monitor an asymmetry measurement from the read sensor during the lapping;

control circuitry coupled to the moving mechanism and the processing circuitry, which is operative to cause the lapping to terminate based on the monitoring of the asymmetry measurement.

2. The slider lapping system of claim 1, wherein the lapping of the slider is terminated when the asymmetry measurement is within a predetermined range.

3. The slider lapping system of claim 1, wherein the producing of the magnetic field comprises producing the magnetic field with a direct current (DC).

4. The slider lapping system of claim 1, wherein the producing of the magnetic field comprises producing the magnetic field at a predetermined frequency.

5. The slider lapping system of claim 1, wherein the asymmetry measurement is based on $(A-B)/(A+B)=-3\pi/4$ $Peak(2f_0)/Peak(f_0)$, where A is a peak positive readback signal amplitude, B is a peak negative readback signal amplitude, and $f_0$ is frequency.

6. A slider lapping system, comprising:

a lapping plate for lapping a slider which includes at least one magnetic head with a read sensor;

a moving mechanism which moves the lapping plate relative to the slider;

a coil which produces a magnetic field around the slider during the lapping;

processing circuitry which is operative to monitor a readback signal amplitude of the read sensor during the lapping;

the processing circuitry being further operative to calculate an asymmetry measurement of the read sensor; and control circuitry coupled to the moving mechanism and the processing circuitry, which is operative to cause the lapping to terminate based on the monitoring of the readback signal amplitude and the asymmetry measurement of the read sensor.

7. The slider lapping system of claim 6, wherein the asymmetry measurement is calculated based on a ratio of the $2^{nd}$ harmonic ($2f_0$) and the $1^{st}$ harmonic ($f_0$) of the read signal from the read sensor.

8. The slider lapping system of claim 6, wherein the lapping of the slider is terminated when the asymmetry measurement is within a predetermined range.

9. The slider lapping system of claim 6, wherein the asymmetry measurement is based on $(A-B)/(A+B)=-3\pi/4$ $Peak(2f_0)/Peak(f_0)$, where A is a peak positive readback signal amplitude, B is a peak negative readback signal amplitude, and $f_0$ is frequency.

10. The slider lapping system of claim 6, wherein the control circuitry is operative to cause the lapping of the slider to terminate when the readback signal amplitude is above a predetermined minimum threshold or reaches its peak value.

11. The slider lapping system of claim 6, further comprising:

the processing circuitry being further operative to monitor a resistance of the read sensor during the lapping; and the control circuitry being further operative to cause the lapping to terminate based on the monitoring of the readback signal amplitude and the resistance of the read sensor.

12. The slider lapping system of claim 6, further comprising:

the processing circuitry being further operative to monitor a resistance of the read sensor during the lapping; and the control circuitry being further operative to cause the lapping to terminate when the readback signal amplitude is above a predetermined amplitude threshold or reaches its peak value, and the resistance is within a predetermined resistance range.

13. The slider lapping system of claim 6, further comprising:

the coil being driven to produce a magnetic field with a direct current (DC).

14. The slider lapping system of claim 6, further comprising:

the coil being driven to produce a magnetic field at a predetermined frequency.

15. The slider lapping system of claim 6, further comprising:

the coil being driven to produce a magnetic field at a predetermined frequency; and the processing circuitry being further operative to perform a Fast Fourier Transform (FFT) or a Phase-Locked-Loop (PLL) at the predetermined frequency for use in monitoring the readback signal amplitude.

* * * * *